United States Patent [19]

Viljanmaa

[11] Patent Number: 4,507,943

[45] Date of Patent: Apr. 2, 1985

[54] DRYING PRESS FOR HIDES

[76] Inventor: Antti K. Viljanmaa, Pirkantie 15, 34800 Virrat, Finland

[21] Appl. No.: 414,446

[22] Filed: Sep. 2, 1982

[30] Foreign Application Priority Data

Sep. 4, 1981 [FI] Finland ..... 812743

[51] Int. Cl.[3] ..... C14B 1/02; C14B 1/30; C14B 17/06

[52] U.S. Cl. ..... 69/41; 69/48; 100/118; 100/152

[58] Field of Search ..... 69/8, 19, 19.1, 19.3, 69/41, 43, 47, 48; 100/118, 152

[56] References Cited

U.S. PATENT DOCUMENTS

| | | | |
|---|---|---|---|
| 2,439,419 | 4/1948 | Donner | 69/41 X |
| 2,995,024 | 8/1961 | Jones | 69/41 |
| 3,324,915 | 6/1967 | Townsend | 69/43 X |
| 3,349,583 | 10/1967 | Schwaller | 69/43 |
| 4,100,773 | 7/1978 | Repetto | 69/48 |

*Primary Examiner*—Wm. Carter Reynolds
*Attorney, Agent, or Firm*—Schiller & Pandiscio

[57] ABSTRACT

A drying press for hides, comprising two endless drying felts (1; 4) passed over rolls (2, 3; 5, 6), said felts being pressed against each other at press rolls (2, 5) to form a drying press gap for hides which are passed therethrough, as well as hide stretching means upstream of said gap. A problem to be solved is to provide such hide stretching means that can be used to effectively prevent the folding of the trailing edges of hides to be fed through a drying press. To solve this problem, there are an upper stretcher (8) and a lower stretcher (7) between which a hide (18) is passed while being lifted off a drying felt (1). Stretchers (7 and 8) press a hide therebetween with a suitable sliding fitness, said hide keeping taut and off a felt. Those surfaces of stretchers (7 and 8), which come against a hide, are provided with endless stretching belts (9, 10 and 11, 12) displaceable from the center towards the sides, the travelling speed of said belts being higher than that of drying felts (1, 4) and a hide (18) moving therebetween. The belts (9, 10) of a lower stretcher (7) are mounted on a frame (14) displaceable in the conveying direction of hides.

10 Claims, 3 Drawing Figures

DRYING PRESS FOR HIDES

The present invention relates to a drying press for hides, comprising two endless drying felts passed over rolls and pressed against each other at press rolls for a hide dry pressing gap through which hides are conveyed, as well as the hide stretching means upstream of said gap.

A problem with such through-run drying presses is the formation of folds at the trailing edge of a hide. When they pass through the pressing nip, these folds will remain permanently in a hide, which is undesirable. Thus, the formation of folds means deterioration of the quality of the trailing edge of a hide as well as loss of surfase area.

Attempts have been made to prevent the formation of folds e.g. by using helical straightening rolls which press a hide against a felt or some other hide feeding mat. However, these have not been capable of achieving the desired result for the reason that a hide, pressed against a felt or a feeding mat, does not slide laterally by the action of a straightening roll but, instead, the helical ribs of a straightening roll slide upon a hide. Also employed have been plough-shaped stretching means pressable upon a hide but those have neither been able to produce the desired result for the same reason. A wet hide pressed against a felt or some other feeding mat does not slide laterally on such a bed by means of passive, laterally immovable stretching means.

Thus, a major part of the presently available hide drying presses do not function on the through-run principle but a hide is fed half-way through a press, is retracted, turned over and re-fed half-way through. This way, the formation of folds can be substantially eliminated but the work is slow and expensive.

An object of the invention is to provide a drying press for hides operating on the through-run principle and improved in a manner that the formation of folds at the trailing end of a hide is eliminated.

To achieve this object, the basis of the invention is a realization that, first of all, a hide is lifted off a felt or some other feeding mat by means of a lower stretcher disposed below the hide and further use is made of an upper stretcher disposed above the hide, one or both of the stretchers being provided on their surfaces coming against a hide with stretching means displaceable from the center towards the sides. Essential to the invention is, thus, that it makes use of active, laterally displaceable stretching means at the same time a hide is lifted off a felt of a mat by means of stretchers gripping the hide on either side thereof.

The characterizing features of the invention are set forth in the appended claims.

Figure 1:
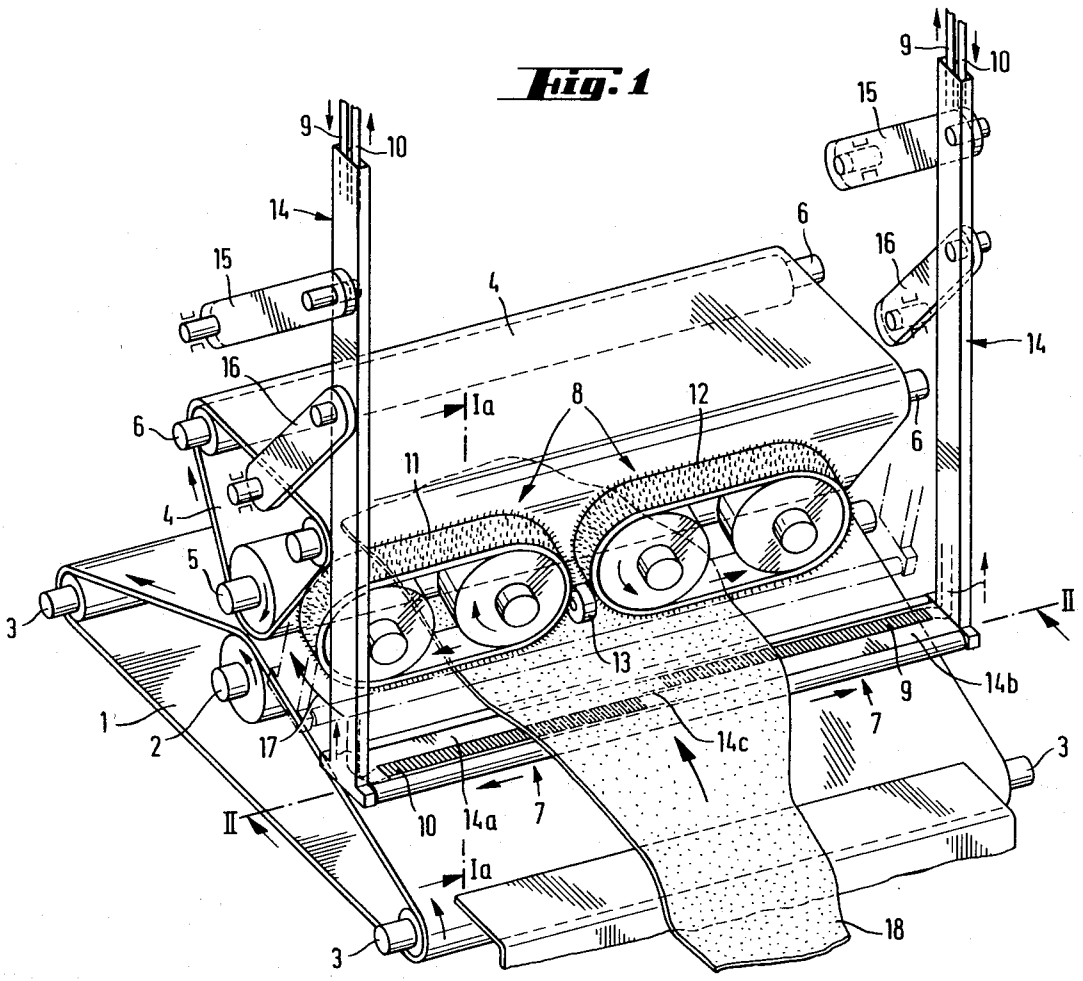
Figure 1A:
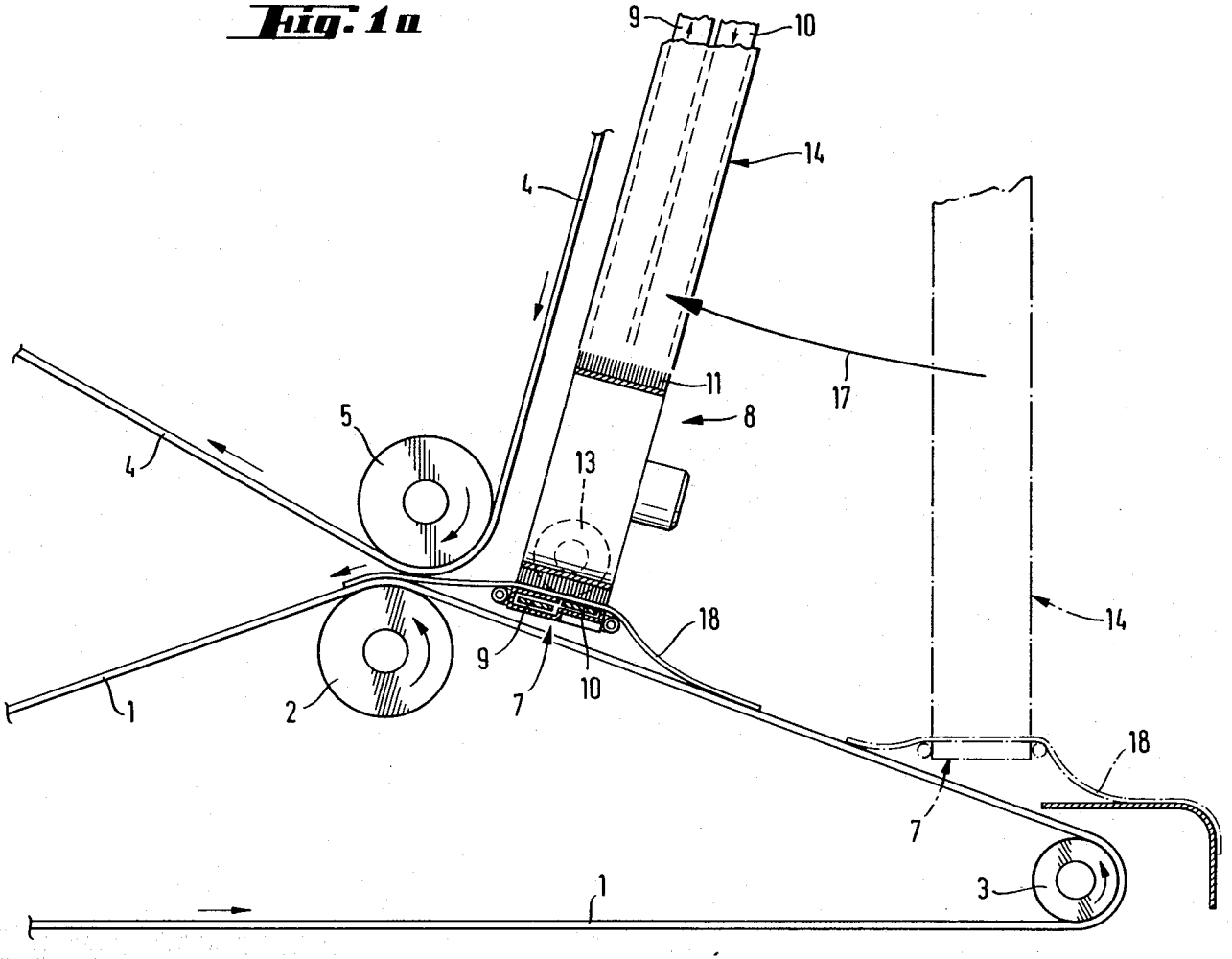
Figure 2:
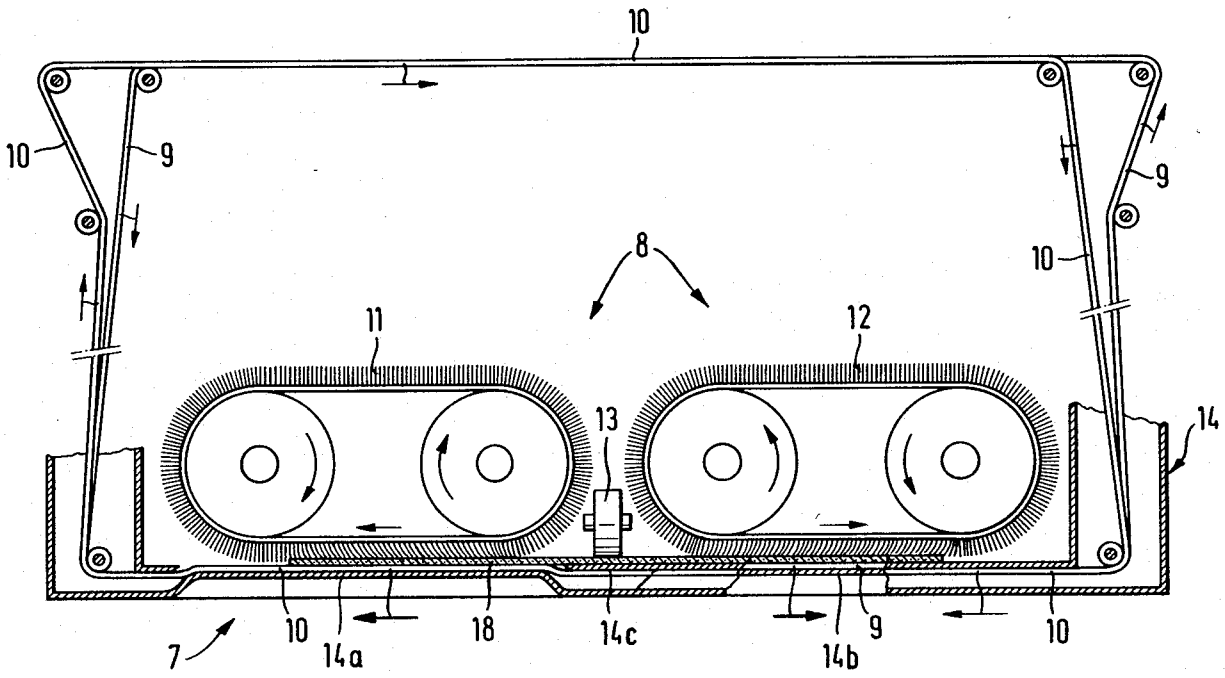

The invention will now be described with reference made to the accompanying drawing, in which FIG. 1 is a perspective view of the constructional principle of a drying press of the invention;

FIG. 1*a* is a cross-sectional view of a portion of the apparatus of FIG. 1; and FIG. 2 is a schematic view of the stretching means of a press in feed direction.

The press comprises a lower drying felt 1 passed over a press roll 2 and swing rolls 3. Accordingly, an upper drying felt 4 is passed over a press roll 5 and swing rolls 6. Between said press rolls 2 and 5 there is formed a press nip in which drying felts are pressed with high pressure against a hide which is fed through a pressing gap. Such through-run leads to folds accumulating at the trailing end of a hide as a result of downstream stretching. To avoid such folding, the press is provided with hide stretching means, as described hereinbelow.

Between a pressing gap formed between press rolls 2 and 5, as close to such gap as possible, there is fitted an upper stretcher 8 which in the present case consists of two brush belts 11 and 12 which are transverse in downstream direction and whose lower runs travel from the center towards the sides. The lower stretcher 7 comprises two endless belts 9 and 10 arranged by means of a suitable roller steering to rotate in a displaceable frame 14. The lower frame element of frame 14 extends above felt 1 in the transverse direction of a press. The parallel belts 9 and 10 are driven by means of a not shown drive means in the directions opposite to each other. The lower frame element of frame 14 is built up in a manner that in the middle of it there is a zone 14*c* covering both belts 9 and 10 but, towards the sides from here, a zone 14*a*, respectively 14*b*, covering just one of the belts (either 9 or 10) the result is that one of the belts 9 and 10, moving at any given time from the middle towards a side, will remain free above. As for their portion remaining free, the belts 9 and 10 are supported by means of not shown rollers disposed within frame 14, so that a hide 18 positioned on top of the lower element of frame 14 rests, with the exception of the central strip, upon the belts 9 and 10 moving from the center towards the sides.

Frame 14 is suspended by means of a four-link system (on both vertical elements of frame 14) made up by link arms 15 and 16 in a manner that the lower element of frame 14 travels as shown by an arrow 17 substantially linearly on top of said felt 1.

Between brush belts 11 and 12 there is further a press roller 13 which prevents lateral feed of a hide in the event that, as a result of the asymmetric shape and position of a hide, either edge of a hide would be subjected to a substantially greater stretching force. In a preferred embodiment, press roller 13 is vertically displaceable.

Operation and function of the device is effected as follows. Brush belts 8 can rotate continuously. With frame 14 in the retracted position shown in FIG. 1, a hide 18 is positioned upon the lower element thereof so that the leading edge of a hide extends slightly forward thereof. Frame 14 is then displaced in the direction of arrow 17 until the lower element of frame 14 reaches a position below brush belts 11 and 12. When frame 14 is being displaced, belts 9 and 10 as well as belts 1 and 4 are automatically actuated. The displacement of frame 14 is effected at a travelling speed substantially corresponding to that of felts 1 and 4, the leading end of hide 18 thus being fed into the pressing nip between rolls 2 and 5. While hide 18 is being pulled through the pressing nip by felts 1 and 4, said hide is pressed between upper stretcher 8 and lower stretcher 7 by suitable sliding fitness, so that said hide remains taut and off felt 1 in the area between the pressing nip of felts 1 and 4 and stretchers 7 and 8. With hide 18 thus held off felt 1, it is possible to obtain the effective stretching of hide which is effected by means of elements stretching a hide on either side, below by means of belts 9 and 10 and above by means of brush belts 11 and 12, These have equal relative travelling speeds but their laterally directed travelling speed is preferably a lot higher than (e.g. at at least twice) the travelling speed of drying felts 1 and 4 which, at the same time, is the travelling speed of hide 18. This higher travelling speed of stretching means leads to an advantage that, despite said stretch braking, a hide does not tend to fold.

Although the above-described embodiment comprises on either side of a hide active, i.e. laterally displaceable stretching means, the invention can be embodied also in a manner that only the upper or lower stretcher is provided with active stretching means, the other stretcher being provided with a sliding surface (metal, nylon etc.) on which a hide slides substantially better than against the surface of an active, laterally displaceable stretching means.

I claim:

1. A drying press for hides, comprising an upper and a lower endless drying felt passed over rolls and pressed against each other by a pair of press rolls to form a drying press gap for hides which are passed therethrough, the lower drying felt extending upstream of the drying press gap, and hide stretching means positioned upstream of the gap and above the lower felt, said hide stretching means including a lower stretcher extending transversely relative to the lower drying felt, said lower stretcher being displaceable in the downstream direction, said lower stretcher serving to lift hides off the lower drying felt, and an upper stretcher which in the final position of the downstream displacement of said lower stretcher is located above the lower stretcher such that the upper and lower stretchers may grip hides therebetween and stretch hides in opposite transverse directions relative to the direction of feed of the hides.

2. A drying press as set forth in claim 1 wherein said upper stretcher includes brush belts arranged on either side of the longitudinal center axis of said press, the lower runs of said brush belts moving from the center towards the sides.

3. A drying press as set forth in claim 1 or 2 wherein the lower stretcher comprises two endless belts arranged to run in a displaceable frame, said belts being arranged to run in opposite directions transverse to the direction of feed of the hides, and said displaceable frame having a lower frame element so disposed as to extend above the lower felt in the transverse direction, said lower frame element being arranged so that to one side of its center it guides the belts so that one is covered and the other is exposed and to the other side of its center it guides the belts so that said one belt is exposed and the other is covered so that a hide to be conveyed can rest upon said exposed belt portions.

4. A drying press as set forth in claim 1 or 2 wherein the lower stretcher is arranged to be displaced on link arms.

5. A drying press as set forth in claim 2 and further including a vertically displaceable press roller between said brush belts.

6. A drying press as set forth in claim 1 or 2, characterized in that the lateral traveling speed of the stretching means is higher, preferably more than twice higher, than that of the drying felts.

7. A drying press as set forth in claim 3 wherein said displaceable frame is arranged to be displaced on link arms.

8. A drying press as set forth in claim 3 further including a vertically displaceable press roller between said brush belts.

9. A drying press as set forth in claim 3 wherein the lateral traveling speed of the stretching means is higher, preferably more than twice higher, than that of the drying felts.

10. A drying press comprising an upper and a lower endless drying felt passed over rolls and pressed against each other by a pair of press rolls to form a drying press gap for hides which are passed therethrough, the lower drying felt extending upstream of the drying press gap, and hide stretching means positioned upstream of the gap and above the lower felt, said hide stretching means comprising a lower stretcher, serving to lift hides off the lower drying felt, extending transversely above the lower drying felt, said lower stretcher comprising a pair of endless belts disposed in a displaceable frame, said belts being arranged so as to move in opposite directions transverse the direction of feed and at a velocity on the order of at least twice the velocity of the drying felts, said frame including a frame member arranged so that on either side of its center it guides the belts so that the outward moving belt is exposed and the inward moving belt is covered in order that a hide to be conveyed may rest upon the exposed belt portions, said frame being displaceable in the downstream direction on and by link arms;

an upper stretcher which in the final position of the downstream displacement of said lower stretcher is located above the lower stretcher such that the upper and lower stretchers may grip hides therebetween and stretch hides in opposite transverse directions relative to the direction of feed of the hides, said upper stretcher comprising a pair of brush belts arranged on either side of the longitudinal center axis of said press, the lower runs of said brush belts moving from the center towards the sides at substantially the same velocity as said endless belts; and a vertically displaceable press roller disposed between said brush belts.

* * * * *